United States Patent [19]

Schafer et al.

[11] 4,430,948

[45] Feb. 14, 1984

[54] FUEL STOKER AND FURNACE

[75] Inventors: Tony L. Schafer; Stephen A. Schafer; Gregory L. Schafer; H. Darwin Swett, all of Dickinson, N. Dak.

[73] Assignee: Western Heating, Inc., Dickinson, N. Dak.

[21] Appl. No.: 402,325

[22] Filed: Jul. 27, 1982

Related U.S. Application Data

[60] Division of Ser. No. 309,245, Oct. 7, 1981, which is a continuation-in-part of Ser. No. 240,213, Mar. 3, 1981, abandoned.

[51] Int. Cl.[3] ..... F23K 3/18

[52] U.S. Cl. ..... 110/101 R; 110/275; 110/288; 126/182; 126/110 R

[58] Field of Search ..... 126/152, 163 R, 182, 126/155, 169, 162, 110 R; 110/115, 327, 165 A, 166, 275, 258, 259, 287, 288, 266, 101

[56] References Cited

U.S. PATENT DOCUMENTS

| | | | |
|---|---|---|---|
| Re. 19,693 | 9/1935 | Best | 110/288 |
| 485,224 | 11/1892 | Pratt . | |
| 945,825 | 1/1910 | Wallis | 126/182 |
| 1,542,193 | 6/1925 | Wald . | |
| 1,888,586 | 11/1932 | Chapman | 126/182 |
| 1,922,960 | 8/1933 | Klein . | |
| 2,047,409 | 3/1937 | Malone . | |
| 2,141,764 | 12/1938 | Riddell . | |
| 2,191,219 | 2/1940 | Peltz | 110/288 |
| 2,255,373 | 9/1941 | Blake | 126/182 |
| 2,452,453 | 10/1948 | Graham . | |
| 2,550,676 | 5/1951 | Dalin . | |
| 2,702,013 | 2/1955 | Atteberry . | |
| 2,780,187 | 2/1957 | Birch | 110/165 R |
| 3,742,874 | 7/1973 | Eff | 110/216 |
| 3,835,817 | 9/1974 | Tuomaala | 122/379 |
| 3,997,000 | 12/1976 | Piela . | |
| 4,007,697 | 2/1977 | Prill | 110/288 |
| 4,078,541 | 3/1978 | Roycraft | 110/260 |
| 4,122,999 | 10/1978 | Belcastro | 126/110 R |
| 4,125,153 | 11/1978 | Stoneberg | 165/166 |
| 4,137,051 | 1/1979 | Godwin . | |

FOREIGN PATENT DOCUMENTS

| | | | |
|---|---|---|---|
| 153582 | 3/1932 | Switzerland | 165/170 |

*Primary Examiner*—Henry C. Yuen

*Attorney, Agent, or Firm*—Burd, Bartz & Gutenkauf

[57] ABSTRACT

A furnace having a primary heat exchange unit also providing a combustion chamber, a secondary heat exchange unit connected by an upper crossover conduit to the primary heat exchange unit, and a tertiary heat exchange unit connected by a lower V-shaped crossover conduit to the secondary heat exchange unit. A third crossover conduit connects the V-shaped crossover conduit with the primary heat exchange unit. Vibrating means are provided between the secondary and tertiary heat exchange units to vibrate the walls thereof and dislodge clinging fly ash so that it falls into the V-shaped crossover conduit for removal by the screw conveyor. A burner assembly of a furnace includes a combustion air housing carrying a circular, stationary grate with an annular valley for carrying fuel during combustion. A central opening is connected to a fuel conveyor for introduction of fuel to the grate through the lower portion of the housing. Combustion air introduction conduits on the housing are remote from the fuel introduction passages and introduce air under pressure at the lower portion of the grate. An agitator and discharge ring is provided on the grate and is rotated on the grate by a suitable drive sprocket mechanism to agitate the fuel for more complete burning thereof and to remove burned ash. A horizontal burner plate is supported by a plurality of legs connected to the agitator and discharge ring over the grate to promote more complete combustion of the fuel.

23 Claims, 19 Drawing Figures

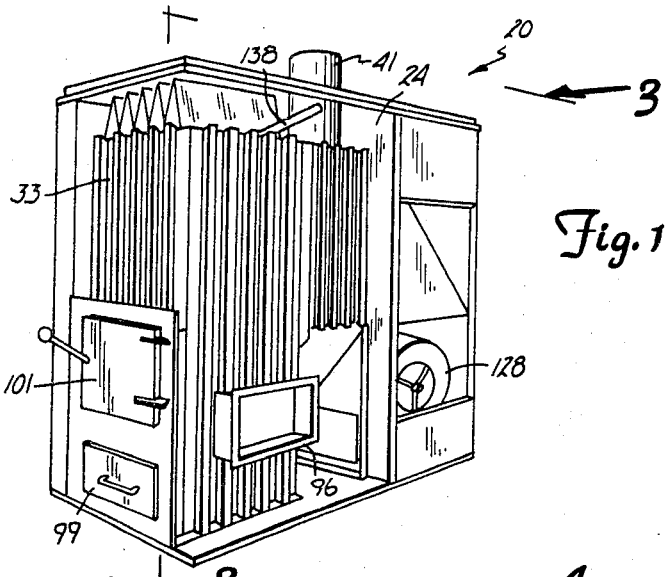
Fig. 1
Fig. 3
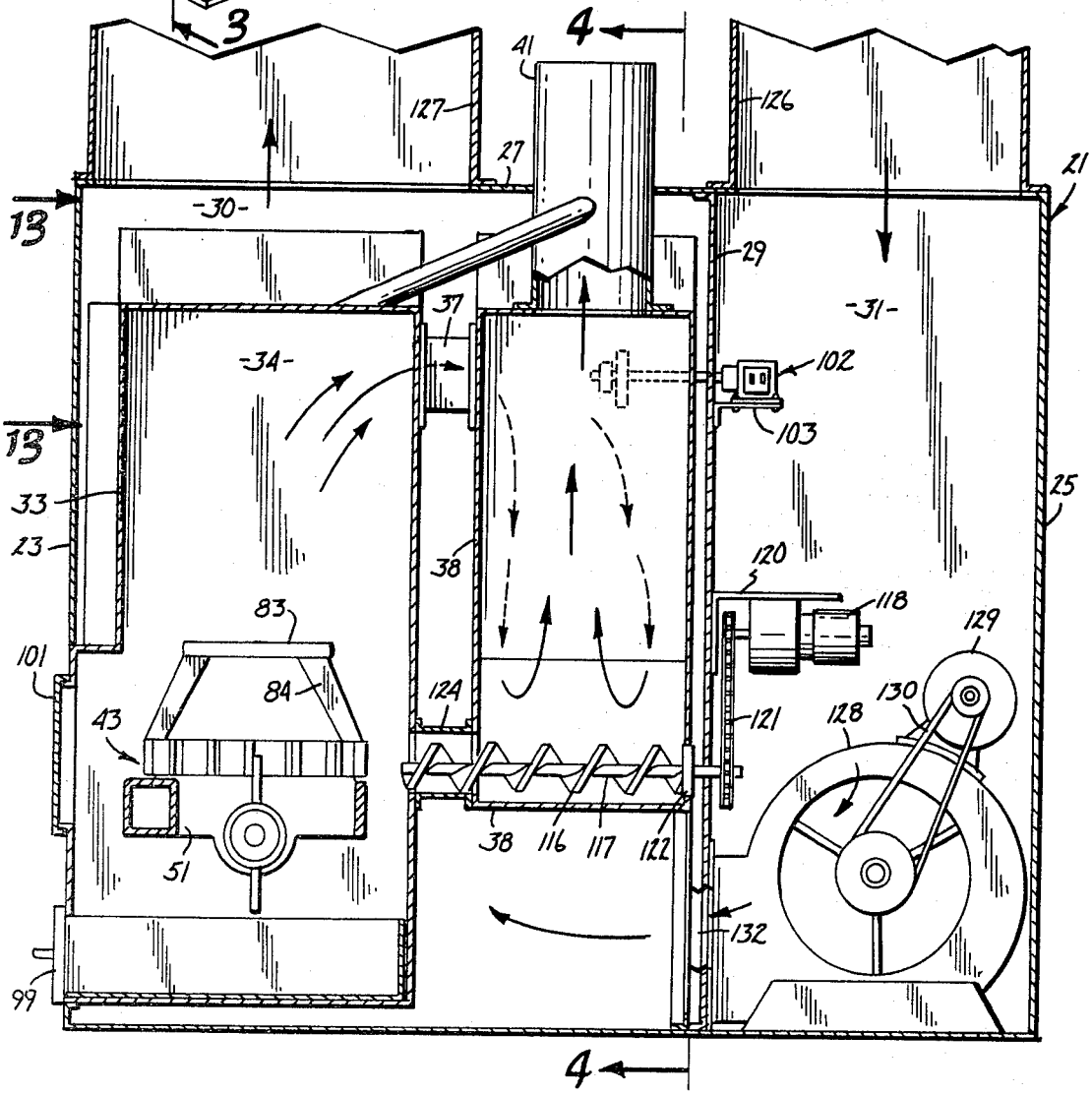

FUEL STOKER AND FURNACE

CROSS REFERENCE TO RELATED APPLICATIONS

This application is a division of application Ser. No. 309,245 filed Oct. 7, 1981, which is a continuation-in-part of application Ser. No. 240,213 filed Mar. 3, 1981, now abandoned.

BACKGROUND OF THE INVENTION

The invention pertains to a furnace and a stoker for a furnace which uses combustion air supplied by a blower, and fuel fed by a conveyor screw inserted into a hot air heat exchanger. The furnace is particularly adaptable for use in domestic and commercial heating, but is also adaptable in commercial and agricultural drying applications.

In prior art furnaces, solid fuels such as bio-mass pellets and coal are burned in a number of ways. Stoker assemblies are provided which convey fuel to the surface of a rotating annular grate disposed in an angular plane allowing accumulated ash to fall off the lower edge of the grate by gravity. Such assemblies result in the formation or large clinkers when burning coal and are also inefficient with regard to achieving complete combustion of the fuel.

In other types of the devices, a fire port is utilized having an enclosed lower retort portion which continues upward and has openings which constitute a tuyere. Clinker formation is enhanced when coal is burned inside such an enclosure. In such devices in which combustion air is fed into the sides or bottom of the retort, there is a risk that, during the idle cycle of the device, a cap of clinkers may form at the top of the pot diverting combustion air into the fuel conveyor mechanism, igniting fuel therein. If not discovered early, this process can continue until ignition progresses through the fuel conveyor to the fuel storage bin.

Another variety of stoker mechanisms utilizes a flat, stationary grate system and employs apparatus for fuel to enter one side of the grate, be transported across the grate upon which combustion takes place, and thence, as ash, to fall by gravity into a suitable container or removal conveyor. These devices are wasteful insofar as they do not achieve complete combustion of the fuel. Additionally, such devices, through the manner in which fresh fuel is co-mingled with burning fuel, create an inordinate amount of noxious emissions which generally cannot later be modified in the burning process and which thus enter the atmosphere as pollutants.

Some burning devices incorporate mechanism for secondary combustion of gases given off by heated fuels or partially burned fuels. These mechanisms are cumbersome, require periodic adjustment and a separate combustion air source also subject to adjustment, and are only partially successful in achieving secondary combustion of gases.

A further burning device incorporates a circular, horizontal stationary grate upon which a concentric ring with dependent teeth is caused to periodically rotate when engaged by a drive sprocket. The object of the concentric ring is to break up and discharge clinkers and ash formed in the combustion process. Because of the upward angle in which the drive sprocket tooth attacks the dependent teeth on the concentric ring, the ring is frequently lifted from the grate and becoms either jammed or dislodged causing malfunction of the entire apparatus.

A disadvantage shared by all stoker fed burning devices using combustion air supplied by a blower is the creation, in the burning process, of a quantity of finely divided particulate matter commonly called fly ash. In most such burning devices fly ash is caught up in the exhaust gases of the device and eventually is expelled into the atmosphere.

SUMMARY OF THE INVENTION

According to the present invention, there is provided a furnace having a primary heat exchange unit serving also as a combustion chamber, a secondary heat exchange unit connected by an upper crossover conduit to the primary heat exchange unit, and a tertiary heat exchange unit connected by a lower crossover conduit to the secondary heat exchange unit. In one form of the invention, fourth and fifth heat exchange units are provided as well. A screw conveyor is provided to convey solid fuel such as coal to a burner assembly located in the combustion chamber. The burner assembly includes a combustion air housing carrying a circular, stationary grate having an annular valley for carrying fuel during combustion. The housing has a central opening which is connected to the fuel conveyor for introduction of fuel to the grate through the lower portion of the housing. The housing also has combustion air introduction conduits which introduce air under pressure at the lower portion of the grate. An agitator and discharge ring is situated on the grate and is rotated on the grate by a suitable drive sprocket mechanism connected to the screw conveyor. A horizontal burner plate is supported on the discharge ring by suitable legs and is disposed above the grate to promote more complete combustion of the fuel. The burner plate can be formed of a high temperature ceramic type material.

A fly ash removal assembly is located in the lower crossover conduit between the secondary and tertiary heat exchangers and includes an actuator for vibration of the walls of the heat exchanger to loosen fly ash and cause it to drop to the lower portion of the crossover conduit where it is carried by a fly ash conveyor screw to the primary heat exchange unit for disposal along with spent ashes.

The burner assembly provides for the inhibition of the formation of all but very small clinkers, an extremely high degree of reliability and operation, simple and relatively inexpensive construction, adaptability to a wide variety of sizes and uses, and substantially complete combustion of both solid fuel as well as combustible gases produced by burning solid fuels. Maximum heat recovery is achieved in the ommission of potentially dangerous pollutants into the atmosphere is minimized.

Additionally, fly ash is deflected away from the main current of the combustion gases emitted into the atmosphere as exhaust, and pollution from fine and particulate matter is substantially reduced.

IN THE DRAWINGS

FIG. 1 is a perspective view of a furnace according to the invention with certain side walls and the stoker and burner assemblies removed for purposes of illustration;

FIG. 3 is an enlarged sectional view of the furnace of FIG. 1 taken along the line 3—3 thereof;

DESCRIPTION OF PREFERRED EMBODIMENTS

Figure 2:
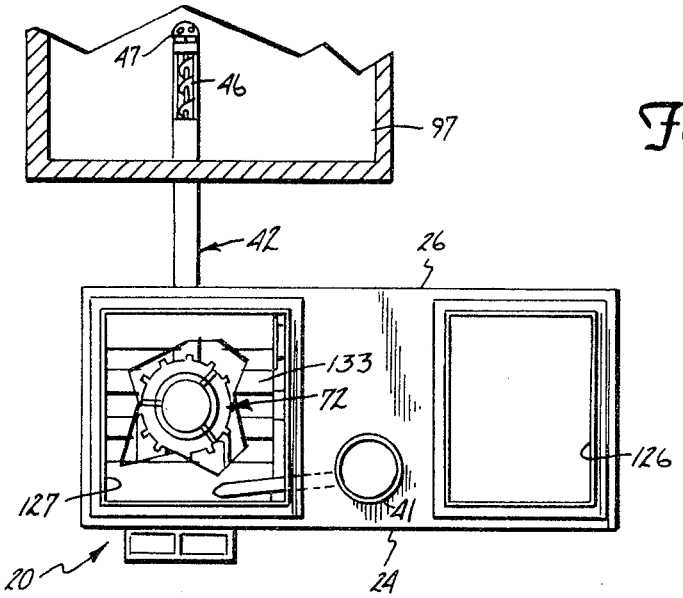
FIG. 2 is an enlarged top plan view of the furnace of FIG. 1.
Figure 4:
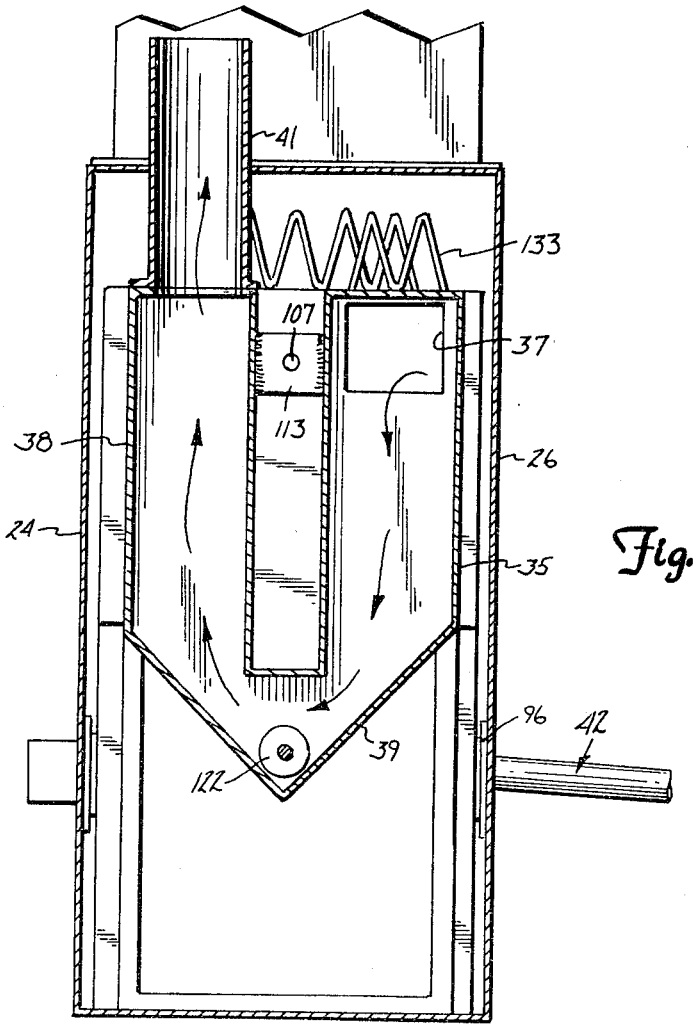
FIG. 4 is a sectional view of the furnace as shown in FIG. 3 taken along the line 4—4 thereof.

Referring to the drawings, there is shown in FIGS. 1 through 3 a hot air furnace 20 according to the invention having a furnace cabinet or housing 21 comprised of side walls 23 through 26 and a top wall 27. An intermediate vertical wall 29 separates cabinet 11 into a furnace compartment 30 and a blower compartment 31. A heat exchange assembly for furnace 20 located in furnace compartment 30 of cabinet 21 includes a primary heat exchange unit 33 which also defines a combustion chamber 34. A secondary heat exchange unit 35 is located adjacent primary heat exchange unit 33 and is connected to it by an upper crossover conduit 37 (FIG. 4). A tertiary heat exchange unit 38 is located adjacent secondary heat exchange unit 35 and is connected to it by a triangularly shaped crossover conduit 39. Lower crossover conduit 39 has a downwardly directed apex and extends substantially the length of both secondary and tertiary heat exchange units 35, 38. Secondary and tertiary heat exchange units 35, 38 are disposed in side-by-side relationship both in facing relationship to primary heat exchange unit 33. A combustion gas exhaust flue 41 extends from the upper wall of tertiary heat exchanger 38, outside of cabinet 21 to a place of exhaust. Exhaust products produced in combustion chamber 34 follow a path through the upper crossover conduit 37 to the secondary heat exchanger 35 downwardly through the lower crossover conduit 39 and then into tertiary heat exchanger 38 where they are then exhausted through flue 41.

Figure 5:
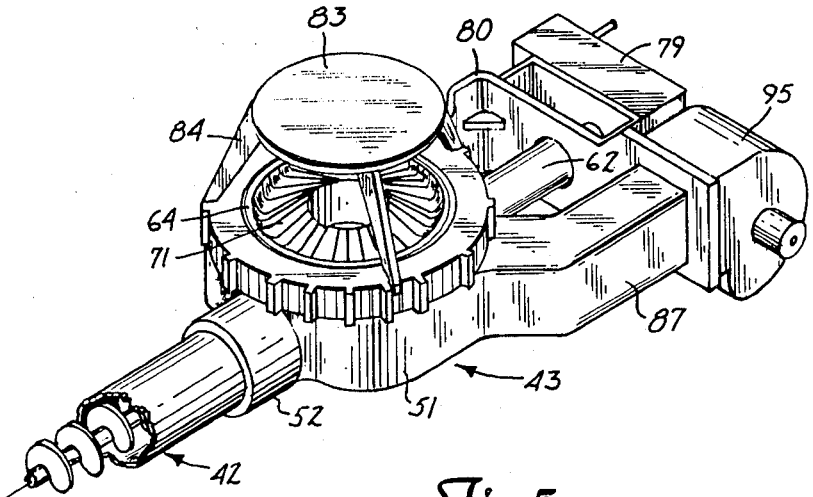
FIG. 5 is a perspective view of the stoker and burner assemblies of the furnace of FIG. 1.

Referring to FIG. 5, there is shown in perspective a fuel screw conveyor assembly 42 connected to a burner assembly 43. Fuel screw conveyor assembly 42 includes a tubular housing 44 partially enclosing a screw conveyor 46. An end plate 47 is located at the end of tube 44 and is held by leveling screws 48. The flight of screw conveyor 46 is carried on a rotatable screw conveyor shaft 49 which extends from end plate 47 to burner assembly 43.

As shown in FIGS. 5 through 9, burner assembly 43 includes a combustion air housing 51 having a circular neck or fuel port 52 for telescopic connection to the end of tube 44 of conveyor assembly 42 providing a fuel entry port to the burner assembly 43. Combustion air housing 51 has a central fuel orifice 53 open to the fuel port 52 for the introduction to the burner assembly of solid fuel conveyed by conveyor assembly 42.

An end portion of shaft 49 of screw conveyor 46 is located in a bearing support opening 55 of housing 51. The tip 56 of shaft 49 is externally squared and extends outwardly of bearing support 55 into an internally squared end opening 59 of a ring rotating sprocket 60. A fuel conveyor shaft washer 57 is disposed between sprocket 60 and bearing support 55.

Figure 7:
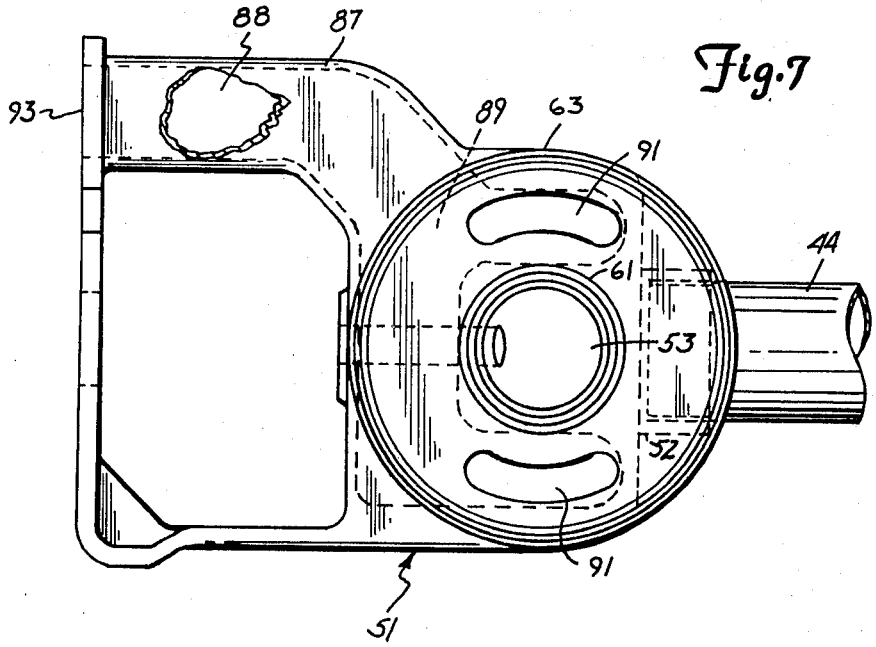
FIG. 7 is a top plan view of the burner housing of the burner assembly as shown in FIG. 6.
Figure 8:
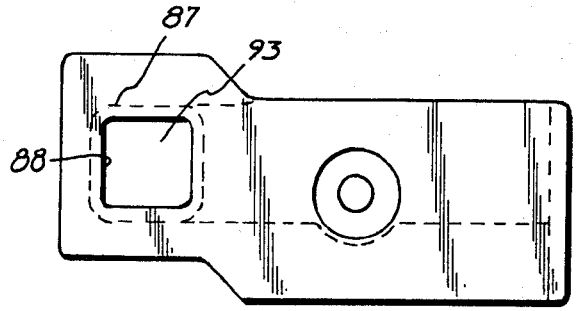
FIG. 8 is an end view of the burner housing of FIG. 7.

The upper surface of the combustion air housing 51 is a generally circular surface with a first pair of concentric circular flanges 61 in close surrounding relationship to fuel orifice 53 (see FIG. 7). A second pair of concentric flanges 63 is located in radially spaced relationship from the first pair 61. An annular fuel grate 64 is positioned on the upper surface of combustion air housing 51. Grate 64 has an interior annular wall 65 with a lower tapered edge fitted into the valley between the flanges of the first pair 61 to form a grate seal. Grate 64 has an outer annular wall 67 having a tapered lower edge to fit in the valley between the second or outer pair of flanges 63 providing an outer grate seal. Grate 64 has a contoured surface between the inner and outer walls 65, 67 forming an annular burning trough 68. Trough 68 has a downwardly sloping surface extending from the upper edge of inner wall 65 to a trough bottom where the surface turns abruptly upward toward the upper edge of outer wall 67. A circumferential horizontal bearing support ledge 69 is located at the upper edge of outer wall 67.

A plurality of radially extending openings 71 are provided in trough 68 extended between the edges of inner and outer walls 65, 67 open to the space between the grate surface and the combustion air housing top surface.

An annular agitator and discharge ring 72 is coaxially mounted on bearing ledge 69 of grate 64 for rotation thereon. Discharge ring 72 is centrally open over grate 64 and has an outer planar horizontal rim 73 in contact with bearing support ledge 69. A vertical side wall 74 extends downwardly from the horizontal rim 73 in straddling relationship to the outer wall 67 of grate 64. A plurality of vertical teeth 76 extend outwardly from vertical wall 74 and are equally spaced about the perimeter thereof. The inner upper edge of discharge ring 72 is beveled at an angle of approximately 54 degrees.

Figure 10:
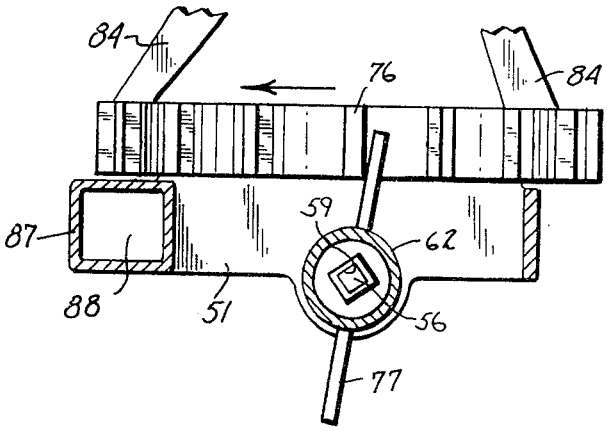
FIG. 10 is a sectional view of a portion of the stoker and burner assembly shown in FIG. 9 taken along the line 10—10 thereof.

Ring rotating sprocket 60 includes a tubular shaft 62 and a pair of diametrically aligned generally radially extending teeth 77. More or less teeth could be provided. Shaft 62 is at a slight inclination to the horizontal in axial alignment with the conveyor shaft 49 of fuel screw conveyor 46. Sprocket teeth 77 extend from shaft 62 angularly so as to be vertically oriented when rotated to the upper side of shaft 62. As shown in FIG. 10, the sprocket teeth 77 have sufficient length and are purposefully orientated so as to enable engagement of a sprocket tooth 77 with a discharge ring tooth 76 at a position at or slightly above a medium line through the body of the agitator and discharge ring 72. This relative positioning avoids disengagement of the agitator and discharge ring 72 upon being rotated by ring rotating sprocket 60.

Figure 9:
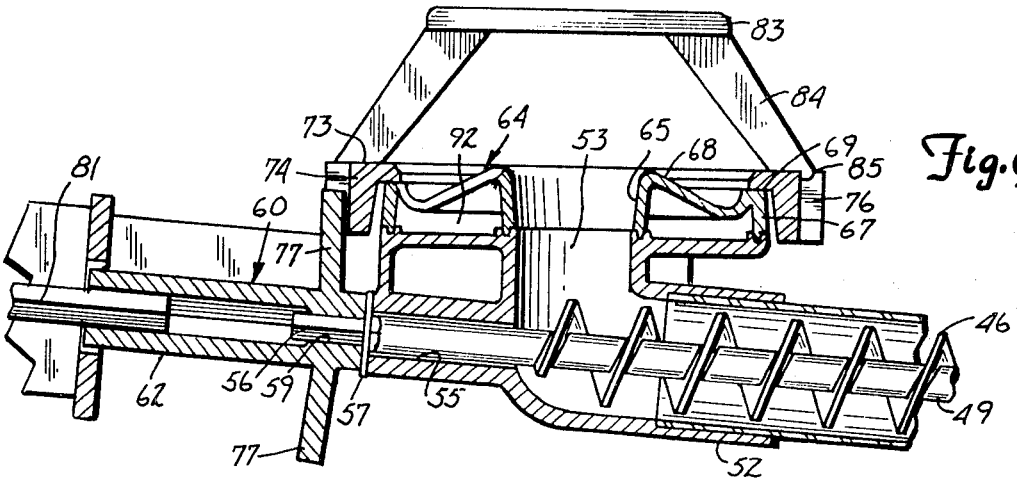
FIG. 9 is a sectional view of the portions of the stoker and burner assemblies of FIG. 6 taken along the line 9—9 thereof.

As shown in FIG. 5, a gear reduction box 79 is mounted on a plate 80 connected to the combustion air housing 51. Gear reduction box 79 has an output shaft 81 which is externally squared and is connected to the internally squared end of shaft 62 of ring rotating sprocket 60 (FIG. 9). Gear reduction box 79 is operated by a suitable variable speed electric motor (not shown) to rotate output shaft 81 which results in rotation of ring rotating sprocket 60. Rotation of ring rotating sprocket 60 results in rotation of the agitator and discharge ring through the teeth 77 engaging the discharge ring teeth 76. At the same time, rotation of the ring rotating sprocket 60 results in rotation of the shaft 49 of fuel screw conveyor 46 to deliver fuel to the fuel to the fuel orifice 53 of combustion air housing 51.

A round, flat horizontally disposed combustion burner plate 83 is supported by a plurality of legs 84 in position horizontally spaced above the burner grate 64. Each leg 84 has an upper end connected to the lower surface of plate 83, and a lower end in engagement with the upper horizontal surface 73 of agitator and discharge ring 72. A stabilizing tooth 85 on each leg 84 extends over the edge of horizontal surface 73 of agitator ring 72 to further secure the legs 84 and plate 83 in place.

Combustion air housing 51 is formed with a combustion air duct 87 providing a combustion air passage 88 to a chamber 89 located beneath grate 64 in housing 51. Air passage 88 is remote from fuel entry port 52 of housing 51. A pair of combustion air apertures 91 are located on the top surface of combustion air housing 51 open to chamber 89 below, and open to a pressurized air space 92 located above the top wall of housing 51 and beneath grate 64 (FIGS. 7 and 9).

As shown in FIG. 5, a combustion air blower 95 with a self-contained motor is mounted on plate 80 with a discharge aligned with the inlet opening 93 to duct 87 to provide combustion air to the combustion air housing 51, through the passage 88, to the chamber 89, through combustion air apertures 91 to the pressurized space 92. Air is then available to pass through the openings 71 in grate 64 for combustion in the trough 68.

Figure 6:
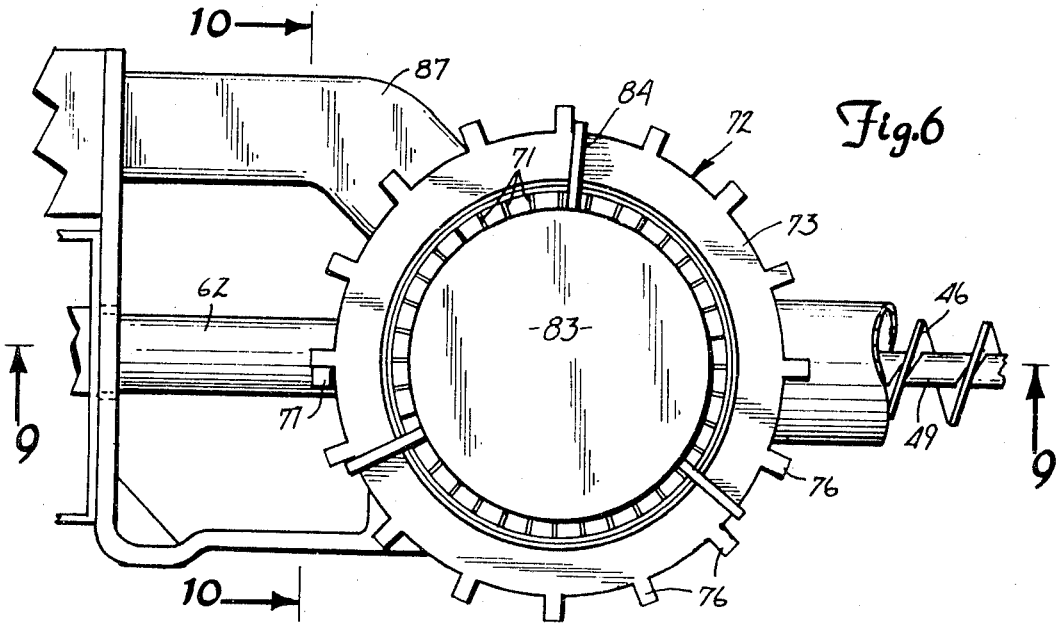
FIG. 6 is an enlarged top plan view of a portion of the stoker and burner assemblies of FIG. 5.

Primary heat exchange unit 33 has two identical, symmetrically positioned stoker ports 96 located on opposite side walls so that the screw conveyor and burner assemblies can be installed therein with the screw conveyor assembly extended from either side. In installed fashion, approximately that much of the screw conveyor and burner assemblies shown in FIG. 6 are located inside the combustion chamber 34 with the plate 80 closing one stoker port and the screw conveyor housing 44 extending through the other with suitable closure means around it (not shown). Burner assembly 43 is positioned centrally within the combustion chamber 34. The intake end of the fuel screw conveyor 46 is placed within an existing fuel bin. The fuel screw conveyor intake end is provided with the end plate 47 attached to the fuel screw conveyor tube 44 which serves as a thrust bearing for the screw conveyor shaft 49. The screw conveyor end plate 47 is provided with two leveling screws 48 which are adjusted to align the screw conveyor to an upward slope from intake end to discharge end of approximately 4 degrees. When this adjustment is achieved, the agitator and discharge ring 72, and the combustion burner plate 83, both attached at the discharge end of the fuel screw conveyor, are substantially level.

Fuel from a bin, indicated at 97 in FIG. 2, is picked up by the screw conveyor and transported upwardly into the combustion chamber 34. The screw conveyor moves the fuel up to the fuel orifice 53 of air combustion housing 51. The fuel moves into the trough of grate 64 for combustion. Combustion air is provided through the duct 87, into the chamber 89, through the combustion air apertures 91 to the pressurized air space 92. This air rises through the openings 71 of grate 64 for mixture and combustion of the fuel located therein.

Screw conveyor shaft 49 is rotated by ring rotating sprocket 60 which is rotated by output shaft 81 of gear box 79. At the same time, sprocket teeth 77 rotate to positions in engagement with the agitator and discharge ring teeth 74 to rotate the agitator and discharge ring on the bearing support surface 69 of grate 64. Grate 64 is sealed with respect to the upper surface of air combustion housing 51 at the inner and outer flanges 61, 63 whereby combustion air does not mix with the fuel until the combustion air passes through the lower openings 71 of the grate 64.

The inner margin or edge of the agitator and discharge ring 72 is flat to form a rotating wall which, through friction with fuel lumps and particles, transmits movement to the mass of fuel. This movement of the fuel mass inhibits the formation of clinkers and assures complete exposure of all elements of the fuel mass to combustion air for efficient combustion. Also, upon rotation, the agitator and discharge ring 72, by gravity, discharges accumulated ash from its flat planar upper surface which accumulates in an ash drawer 99 located just beneath it (FIG. 3) which can be periodically removed and emptied. Access to the interior of combustion chamber 34 can be had through door 101 for purposes of servicing burner assembly 43 or the like.

During combustion in grate 64, heated gases, some of which are combustible, and fly ash, are forced upward and inward by the force of combustion air perculating through the burning fuel mass. These products are deflected outward and downward by the combustion burner plate. These combustible gases are forced to pass through the area of combustion and are consumed in the flames emanating from the burning fuel mass. Much of the fly ash is deflected into the ash pan or drawer 99 located beneath the burner assembly 43.

Figure 11:
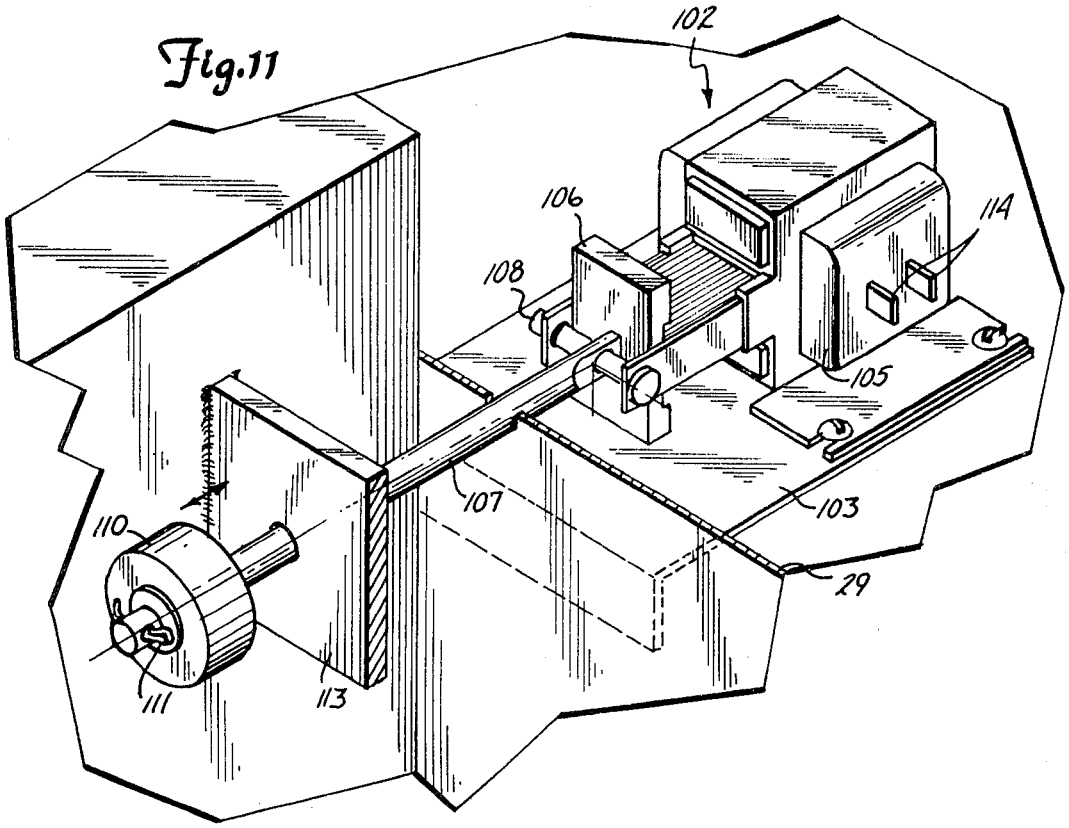
FIG. 11 is a perspective view of the actuating device of the fly ash removal assembly of the furnace of the invention.
Figure 12:
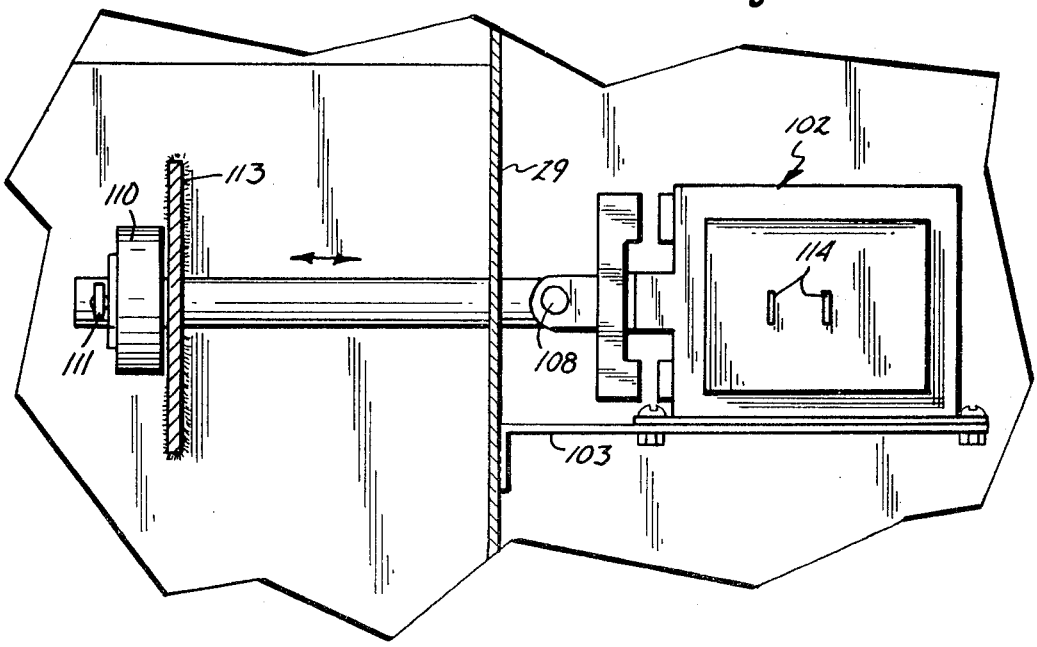
FIG. 12 is a side elevational view of the actuating device as shown in FIG. 11.

Fly ash removal apparatus is mounted between secondary and tertiary heat exchange units 35, 37 for the purpose of removing fly ash collected on the interior walls of the heat exchange units and moving it to ash drawer 99 in primary heat exchange unit 33. As shown in FIG. 3, a vibrating device 102 is mounted on a shelf 103 fixed to intermediate wall 29 in blower compartment 31 of furnace cabinet 21. As shown in FIGS. 11 and 12, vibrating device 102 includes an electric motor comprised as a solenoid coil 105 attached to a yoke 106 which is in turn attached to a vibrating rod 107 by means of a solenoid yoke pin 108. A hammer 110 is attached to the end of vibrating rod 107 by means of a cotter pin 111. The vibrating rod extends through a suitably provided opening in a heat exchange striker plate 113. As shown in FIG. 4, heat exchange striker plate 113 is located between and attached to adjacent walls of the secondary and tertiary heat exchange units 35, 37. The solenoid coil 105 is periodically actuated by electricity through terminals 114. When actuated, rod 107 moves back and forth resulting in hammer 110 striking heat exchanger strike plate 113 causing vibrations in the walls of secondary and tertiary heat exchange units 35, 38 causing fly ash to be dislodged therefrom and fall to the bottom or crossover conduit 39.

The fly ash removal assembly includes a horizontally oriented fly ash conveyor screw 116 mounted in the lower V-shaped crossover conduit 39. Conveyor screw 116 is comprised as a helical flight mounted on a shaft 117. A conveyor screw drive motor 118 is mounted on a bracket 120 secured to intermediate wall 129 in blower compartment 31. The output shaft of motor 118 is connected to a sprocket chain 121 which is connected to one end of shaft 117 of conveyor screw 116 for rotation thereof. Shaft 117 extends through a suitable opening in intermediate wall 29 and the wall of crossover conduit 39 at the juncture of secondary and tertiary heat exchange units 35, 38. The opposite end of lower V-shaped crossover conduit 39 has an opening 123 to a connecting tube 124 which opens into combustion chamber 34 at a point located above ash drawer 99. Fly ash that falls by gravity into the V-shaped crossover conduit 39 is conveyed by screw conveyor 116 into the combustion chamber of primary heat exchange element 33 where it is deposited in the ash drawer 99 for periodic removal. Motor 118, along with vibrating device 102, can be automatically operated periodically as may be required to remove fly ash as may build up.

Figure 13:
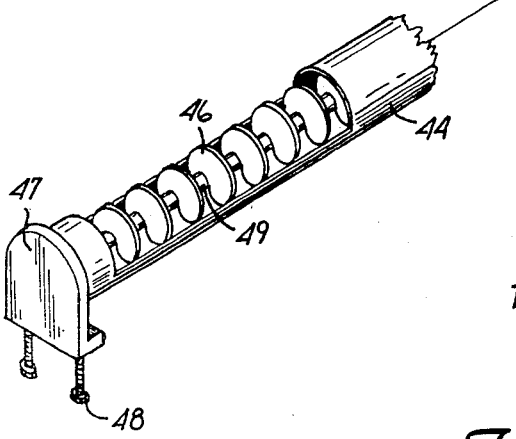
FIG. 13 is an enlarged side elevational view of a portion of the furnace shown in FIG. 3 taken along the line 13—13 thereof.
Figure 13:
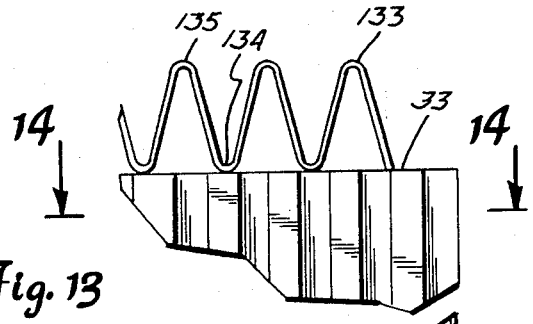
Figure 14:
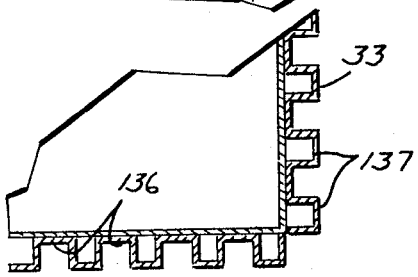
FIG. 14 is a sectional view of a portion of the furnace assembly shown in FIG. 13 taken along the line 14—14 thereof.

A cold air plenum 126 empties into the blower compartment 31 of furnace cabinet 21, drawing air that has cooled from various conventional sources in the building. An air blower 128 is mounted in the blower compartment 31 and is properly connected to a conventional motor 129 by a belt 130 to move air from the blower compartment 31 through an opening 32 in intermediate wall 29 to the furnace compartment 30. A warm air plenum 127 extends from the upper portion of the furnace compartment 30 to the usual warm air distribution system of the building. As the air passes through the furnace compartment 30, it is warmed as it comes in contact with the primary, secondary and tertiary heat exchange units. Heat transfer from the heat exchange units to the passing air can be enhanced by a sinuate heat exchanger plate 133 placed on the top wall of the heat exchanger units as shown in FIGS. 1, 3, 4 and 14. Plate 133, as shown in FIG. 13, consists of alternate valleys 134 and crests 135. In addition, to enhance heat conduction from the heat exchange units, the walls of the heat exchange units can have a sinuate cross-sectional profile, for example, as shown in FIG. 14 where the wall of primary heat exchange unit 33 is shown to have a wall with a square wave-shape cross-section formed of alternating rectangular shaped channels 136 and ridges 137.

In use, fuel conveyor assembly 42 delivers fuel to burner assembly 43 for combustion on grate 64 as previously described. Fuel and combustion air are isolated except at the point of combustion. Agitator and discharge ring 72 operates to prevent clinkers, expose maximum fuel surface to combustion, and discharge ashes to ash drawer 99. As ring rotating sprocket teeth 77 engage the agitator and discharge ring teeth 76 at a point higher than one-half of the distance measured from bottom to top of the vertical surface of the agitator and discharge ring, stability of rotation in a narrowly defined plane is assured. Burner plate 83 deflects uncombusted products of combustion back through the area of combustion for more complete combustion. Heated products of combustion travel upwardly in combustion chamber 34, through upper crossover conduit 37 into the secondary heat exchange unit 35. These products of combustion then travel downwardly in the secondary heat exchange unit 35 through the lower V-shaped crossover conduit 39 into the tertiary heat exchange unit 38 and then up through the flue 41. During the process, heat is extracted from the heat exchangers by air moving from the cold air intake plenum 126 through the blower compartment 31, then into the furnace compartment 30. As the air circulates through the furnace compartment 30, it is heated by the heat exchange units. This heated air then travels through the warm air outlet plenum 127 to the usual warm air distribution system of the building.

Periodically, vibrating device 102 is operated to remove fly ash that may be clinging to the interior wall of the secondary and tertiary heat exchange units 35, 38. This fly ash is dropped by gravity into the V-shaped crossover conduit 39 where it is carried by the fly ash screw conveyor 116 into the combustion chamber 34 to be dropped into the ash drawer 99.

A combustion gas safety vent 138 is connected directly between the upper portion of combustion chamber 34 and the flue 41 to prevent an excessive build-up of products of combustion in the combustion chamber 34.

Figure 15:
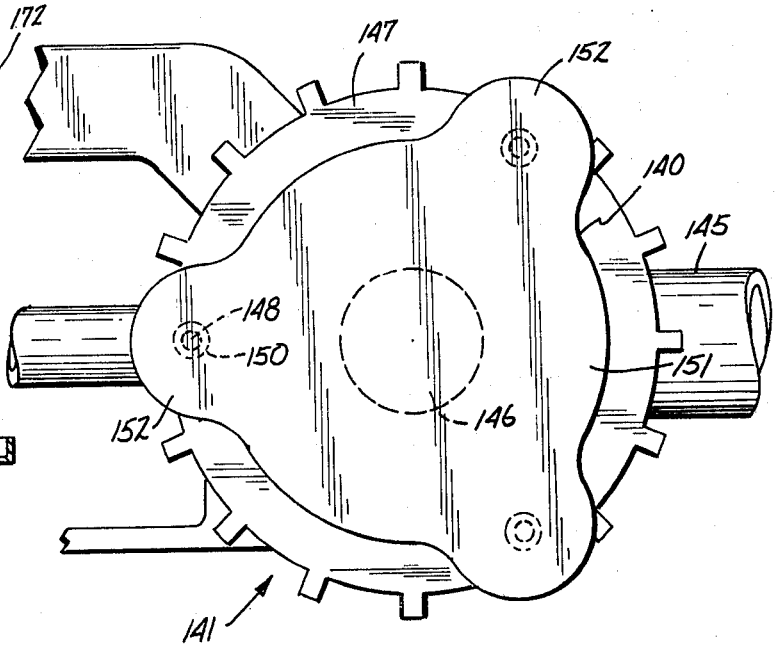
FIG. 15 is a top plan view of a combustion burner plate according to another form of the invention installed on a burner assembly.
Figure 16:
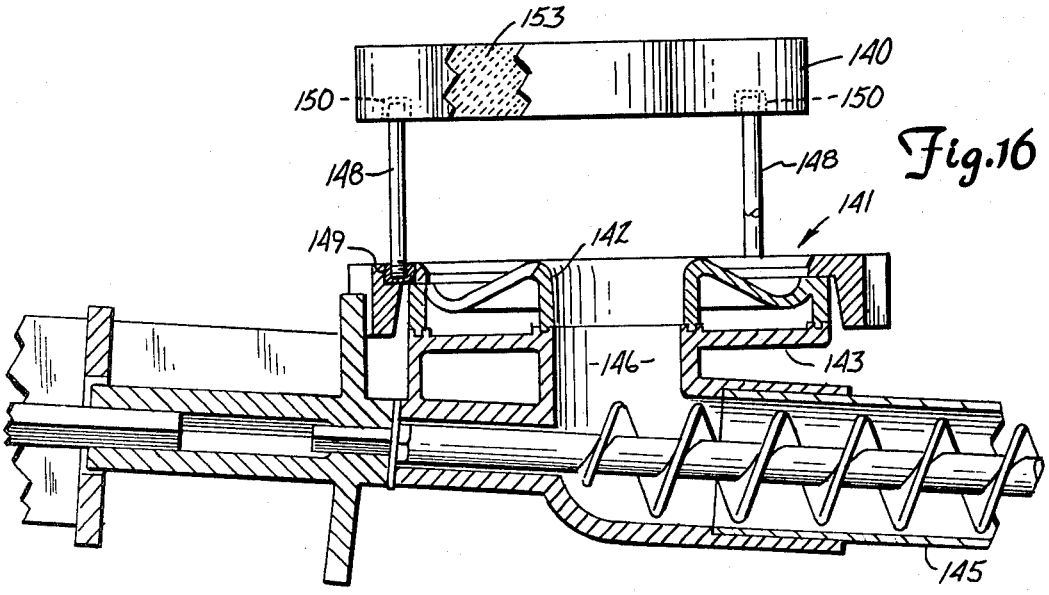
FIG. 16 is a side elevational view of the combustion burner plate and burner assembly of FIG. 15 with portions in section for purposes of illustration.

Referring to FIGS. 15 and 16 there is shown a combustion burner plate 140 according to a modification of the invention installed over a burner assembly 141 of the type earlier described having an annular fuel grate 142 with an annular trough for combustion of fuel, the grate 142 being mounted on a combustion air housing 143 which receives fuel from a fuel conveyor 145 at a fuel opening 146. A rotating agitator and discharge ring 147 is mounted on an upwardly facing flat circumferential ledge of the fuel grate 142. Combustion burner plate 140 is supported by a plurality of vertical legs shown as three legs 148. Each leg 148 extends from the lower surface of combustion burner plate 140 to the upper flat surface of agitator ring 147. The lower end of each leg 148 is installed in an opening 149 formed in the upper surface of agitator ring 147. The upper end of each leg 148 is accommodated in an indentation 150 formed in the lower surface of combustion burner plate 140. Plate 140 is readily removable from the legs 148.

As shown in FIG. 15, combustion burner plate 140 has a generally round central portion 151 of sufficient diameter to encompass the area above the burning trough of grate 142. Burner plate 140 has radial semicircular projections 152 outwardly extended from central portion 151 for accommodation of legs 148. As indicated at 153 in FIG. 16, combustion burner plate 140 is formed of a high temperature ceramic type material to better enable it to withstand the heat generated at burner assembly 141. For example, combustion burner plate 140 can be formed of an alumina-silica composition composed of bulk ceramic fibers and high temperature inorganic binders. Such a composition is sold by the Carborundum Company under the trademark Fiberfrax FC-25 tamping mix.

In use of combustion burner plate 140, during combustion in the grate 142, heated gases, some of which are combustible, are forced upward and inward by the force of combustion air perculating through the burning fuel mass. Combustion burner plate 140 deflects these gases downward and outward where they are forced to pass through the area of combustion once more and are consumed by flames emanating from the burning fuel mass. Burner plate 140 is not damaged by the heat of combustion.

Figure 19:
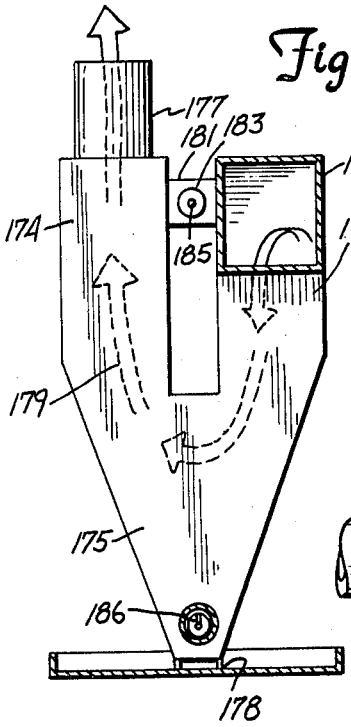
FIG. 19 is a sectional view of a portion of the heat exchange assembly of FIG. 17 taken along the line 19—19 thereof.
Figure 17:
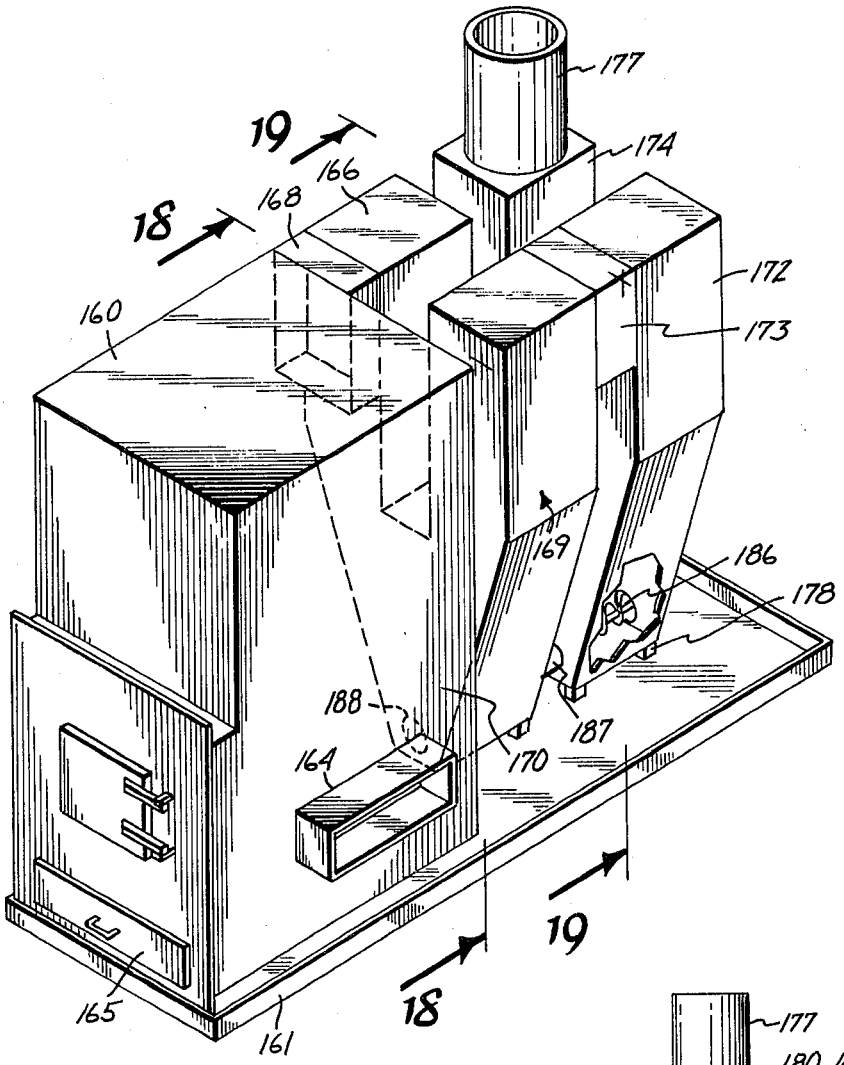
FIG. 17 is a perspective view of a heat exchange assembly according to another form of the invention.
Figure 18:
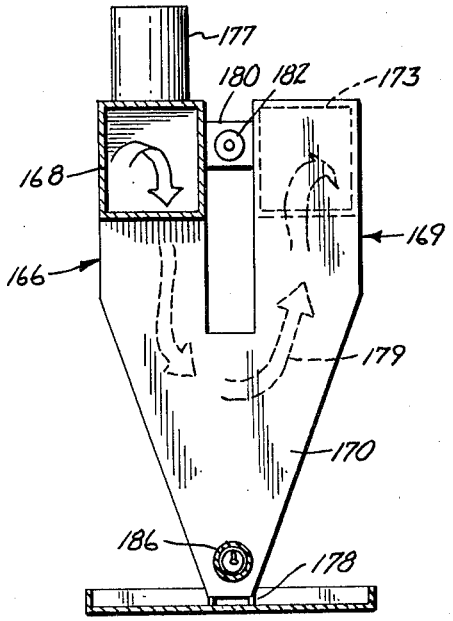
FIG. 18 is a sectional view of a portion of the heat exchange assembly of FIG. 17 taken above the line 18—18 thereof.

Referring to FIGS. 17 through 19, there is shown a modified heat exchange assembly of the invention. A first or primary heat exchange unit 160 is situated on a base 161 and locatable in a furnace cabinet (not shown) as earlier described. Primary heat exchange unit 160 also defines a combustion chamber and accordingly has a stoker port 164 and a removable ash drawer 165. Primary heat exchange unit 160 can contain a burner assembly as previously described. Removable ash drawer 165 is located beneath the burner assembly for removal and disposition of ashes that accumulate from burning solid fuel. A second or secondary heat exchange unit 166 is located adjacent the first heat exchange unit 160 and is connected to it by a first upper crossover conduit 168. A tertiary or third heat exchange unit 169 is located adjacent the second heat exchange unit 167 and is connected to it by a lower V-shaped or generally triangularly shaped crossover conduit 170. Lower crossover conduit 170 has a downwardly directed, truncated apex and extends substantially the length of both the second and third heat exchange units 167, 169. The second and third heat exchange units 167, 169 are disposed in side-by-side relationship and both in facing relationship to the first heat exchange unit 160. The third heat exchange unit 169 is connected to a fourth heat exchange unit 172 by a second upper crossover conduit 173. Fourth heat exchange unit 172 is located adjacent the third heat exchange unit 169 and aligned with the third heat exchange unit 169 and the first heat exchange unit 160. Fourth heat exchange unit 172 is connected to a fifth heat exchange unit 174 by a second V-shaped or triangularly shaped crossover conduit 175 having a downwardly directed, truncated apex and extending substantially the length of both the fourth and fifth heat exchange units 172, 174. Fifth heat exchange unit 174 is located in side-by-side relationship to the fourth heat exchange unit 172 and in facing relationship to the second heat exchange unit 166. A combustion gas flue 177 extends from the upper wall of the fifth heat exchange unit 174 to a remote location for exhaust. The second through fifth heat exchange units provide enclosed chambers for the passage of products of combustion from the combustion chamber of the first heat exchange unit 160.

Exhaust products which are generated in the combustion chamber of the first heat exchange unit 160 follow a path through the first upper crossover conduit 168 to the second heat exchange unit 166, downwardly through the first lower V-shaped crossover conduit 170 to the third heat exchange unit 169 upwardly through the second upper crossover conduit 173 to the fourth heat exchange unit 172, downwardly through the second lower V-shaped crossover conduit 175 to the fifth heat exchange unit 174 as indicated by the arrows 179 in FIGS. 18 and 19. Relatively cooled combustion products are then exhausted through the flue 177. The heat exchange units are formed of heat conductive material, preferably metal, and can be provided with sinuate heat exchange plates or walls as previously described. At each of the heat exchange units, heat is transferred to the interior of the furnace compartment to warm the passing air.

A first strike plate 180 is mounted betwern exterior confronting walls of the second and third heat exchange units 166, 169. A second strike plate 181 ismounted between exterior confronting walls of the fourth and fifth heat exchange units 172, 174. A first hammer 182 is poised adjacent to the first strike plate 180, and a second hammer 183 is poised adjacent the second strike plate 181, both being mounted on a rod 185 connected to a suitable motor for reciprocation (not shown). A fly ash screw conveyor 186 extends along the bottom of second V-shaped crossover conduit 175, through a fly ash conduit 187 that connects the second V-shaped crossover conduit 175 and the first V-shaped crossover conduit 170, through the first V-shaped crossover conduit 170 to a discharge opening 188 to discharge fly ash into the ash drawer 165. Fly ash is dislodged from the interior walls of the heat exchange units in the fashion previously described, by operation of the first and second hammers 182, 183 against the strike plates 180, 181 to dislodge the fly ash whereby it falls to the lower V-shaped crossover conduits and is carried by the screw conveyor 186 back to the interior of the first heat exchange unit 160.

While there has been shown and described preferred embodiments of a furnace according to the invention, it is understood that certain deviations can be had by those skilled in the art without departing from the scope and spirit of the invention.

The embodiments of the invention in which an exclusive property or privilege is claimed are defined as follows:

1. A solid fuel burning assembly comprising:

a combustion air housing having walls defining a chamber and a generally flat top surface for support of a grate, and having a central fuel opening at a first central location connected to a central fuel port for passage of solid fuel from a location beneath the housing to a location above the housing;

a fuel grate located on the top surface of the housing, said fuel grate having an inner annular wall disposed in surrounding relationship to said central fuel opening of the housing with a lower edge in generally sealing relationship to the housing top surface, an outer annular wall radially spaced from the inner annular wall and having a lower edge in generally sealing relationship to the housing top surface, a grate surface extending between the inner annular wall and the outer annular wall and spaced from the top surface of the housing, said grate surface configured sloping gently downward from the upper edge of the inner annular wall to a trough bottom and sloping steeply upward from the trough bottom to the upper edge of the outer annular wall to form an annular solid fuel burning trough, said outer annular wall having an upper horizontal ledge, said grate surface having a plurality of air circulation openings extended between the upper edges of the inner annular wall and the outer annular wall open to the space between the grate surface and the housing top surface;

a rotatable annular agitator and discharge ring mounted coaxially on the grate having an inner edge supported on the horizontal ledge of the outer annular wall of the grate, a horizontal planar upper surface for conveying ashes to the periphery of said agitator and discharge ring for discharge of the ashes, a vertical sidewall disposed in straddling relationship to the outer annular wall of the grate, and a plurality of peripherally spaced, vertical teeth outwardly extended from the sidewall for substantially the height of the sidewall;

a fuel screw conveyor assembly including a tubular screw conveyor housing assembled to the fuel entry port of the combustion air housing, a conveyor shaft located in the tubular screw conveyor housing and a conveyor flight on the conveyor shaft to deliver fuel to the fuel entry port to be moved through the fuel opening to the grate;

said conveyor shaft having a portion extending through the combustion air housing beyond the fuel opening;

means to rotate the agitator and discharge ring including a ring rotating sprocket assembled to the end of the conveyor shaft for rotation with the conveyor shaft, said sprocket having at least one outwardly extended sprocket tooth positioned for engagement ship to the housing top surface, a grate surface extending between the inner annular wall and the outer annular wall and spaced from the top surface of the housing, said grate surface configured sloping gently downward from the upper edge of the inner annular wall to a trough bottom and sloping steeply upward from the trough bottom to the upper edge of the outer annular wall to form an annular solid fuel burning trough, said outer annular wall having an upper horizontal ledge, said grate surface having a plurality of air circulation openings extended between the upper edges of the inner annular wall and the outer annular wall open to the space between the grate surface and the housing top surface;

a rotatable annular agitator and discharge ring mounted coaxially on the grate having an inner edge supported on the horizontal ledge of the outer annular wall of the grate, a horizontal planar upper surface for conveying ashes to the periphery of said agitator and discharge ring for discharge of the ashes, a vertical sidewall disposed in straddling relationship to the outer annular wall of the grate, and a plurality of peripherally spaced, vertical teeth outwardly extended from the sidewall for substantially the height of the sidewall;

a fuel screw conveyor assembly including a tubular screw conveyor housing assembled to the fuel entry port of the combustion air housing, a conveyor shaft located in the tubular screw conveyor housing and a conveyor flight on the conveyor shaft to deliver fuel to the fuel entry port to be moved through the fuel opening to the grate;

said conveyor shaft having a portion extending through the combustion air housing beyond the fuel opening;

means to rotate the agitator and discharge ring including a ring rotating sprocket assembled to the end of the conveyor shaft for rotation with the conveyor shaft, said sprocket having at least one outwardly extended sprocket tooth positioned for engagement with the agitator and discharge ring teeth upon rotation of the sprocket, said sprocket tooth of sufficient length to result in said engagement at a point higher than a median line between the top and bottom of said agitator and discharge ring teeth to rotate said agitator and discharge ring;

means for rotation of the sprocket and conveyor shaft;

said housing having at least one air supply opening in the top surface thereof communicating with said chamber and located beneath the grate surface to supply air under pressure to the grate surface through the grate openings for purposes of combustion with solid fuel introduced to the grate through the fuel opening; and means to supply combustion air under pressure to said chamber including a combustion air duct connected to the combustion air housing at a second location remote from the first central location of the fuel entry port.

2. The fuel burning assembly of claim 1 wherein:

said ring rotating sprocket includes a pair of diametrically aligned sprocket teeth.

3. The fuel burning assembly of claim 1 including:

a generally horizontal burner plate;

means mounting the burner plate over the fuel grate.

4. The fuel burning assembly of claim 3 wherein:

means mounting the burner plate over the fuel grate includes a plurality of legs extending between the burner plate and the agitator and discharge ring.

5. The fuel burning assembly of claim 1 including:

a first pair of concentric circular flanges on the top surface of said combustion air housing in surrounding relationship to said fuel opening;

said inner annular wall of the fuel grate having a tapered lowered edge in sealing engagement between the flanges of said first pair of flanges;

a second pair of circular concentric flanges on the top surface of said housing radially spaced from the first pair of flanges;

said outer annular wall of the fuel grate having a tapered lowered edge in sealing engagement between the flanges of said second pair of flanges.

6. The fuel burning assembly of claim 1 wherein:

said combustion air housing is located in a combustion chamber of a primary heat exchange unit located in a furnace cabinet having walls defining a furnace compartment;

a fuel ash depository located beneath the combustion air housing for collection of ash produced as a result of burning fuel and discharged from the fuel grate by the agitator and discharge ring;

a second heat exchange unit positioned adjacent the primary heat exchange unit in the furnace compartment having an interior for receipt of products of combustion from the primary heat exchange unit;

a first upper crossover conduit connecting the upper portion of the interior of the primary heat exchange unit and the upper portion of the interior of the second heat exchange unit;

a third heat exchange unit positioned adjacent the second heat exchange unit in the furnace compartment having an interior for receipt of products of combustion from the second heat exchange unit and positioned so that the second heat exchange unit and third heat exchange unit are in side-by-side relationship facing the primary heat exchange unit;

a first lower V-shaped crossover conduit connecting the lower portion of the interior of the second heat exchange unit to the lower portion of the interior of the third heat exchange unit along the length thereof in the direction facing the primary heat exchange unit; and flue means communicative with the third heat exchange unit for discharge of products of combustion.

7. The fuel burning assembly of claim 6 including:

a fly ash conduit extended from the V-shaped crossover conduit to the primary heat exchange unit;

a fly ash conveyor screw assembly including a fly ash conveyor screw rotatably located in the V-shaped crossover conduit and extending through the fly ash conduit operative to move fly ash from the V-shaped crossover conduit through the third crossover conduit to be deposited in the ash depository located in the primary heat exchange unit;

means for selective rotation of the fly ash screw conveyor; and vibrating means mounted between adjacent walls of the second and third heat exchange units adapted for vibration thereof to dislodge fly ash and cause it to drop by gravity into the V-shaped crossover conduit.

8. The fuel burning assembly of claim 7 wherein:

said vibrating means includes a strike plate attached between adjacent walls of the second and third heat exchange units, a strike hammer mounted on a rod and positioned closely adjacent the strike plate, said rod being connected to a reciprocating motor whereby said hammer vibrates against said strike plate to induce vibration in the walls of the second and third heat exchange units.

9. The fuel burning assembly of claim 6 including:

a fourth heat exchange unit positioned adjacent the third heat exchange unit in the furnace compartment opposite the primary heat exchange unit;

a second upper crossover conduit connecting the upper portion of the interior of the third heat exchange unit and the upper portion of the interior of the fourth heat exchange unit;

a fifth heat exchange unit positioned adjacent the fourth heat exchange unit and in facing relationship to the second heat exchange unit so that the fourth and fifth heat exchange units are in side-by-side relationship facing the second and third heat exchange units;

a second lower V-shaped crossover conduit connecting the lower portion of the interior of the fourth heat exchange unit to the lower portion of the interior of the fifth heat exchange unit along the length thereof in the direction facing the primary heat exchange unit; and exhaust flue means extended from the fifth heat exchange unit.

10. The fuel burning assembly of claim 9 including:

a first fly ash conduit extended from the first V-shaped crossover conduit to the primary heat exchange unit;

a second fly ash conduit extended from the second V-shaped crossover conduit to the first V-shaped crossover conduit;

a fly ash conveyor screw assembly including a fly ash conveyor screw rotatably located in the first and second V-shaped crossover conduits and extending through the first and second fly ash conduits operative to move fly ash from the V-shaped crossover conduits through the fly ash conduits to be deposited in the ash depository located in the primary heat exchange unit;

means for selective rotation of the fly ash screw conveyor; and vibrating means mounted between adjacent walls of the second and third heat exchange units and between adjacent walls of the fourth and fifth heat exchange units adapted for vibration thereof to dislodge fly ash and cause it to drop by gravity into the V-shaped crossover conduits.

11. The fuel burning assembly of claim 10 wherein:

said vibrating means include a first strike plate attached between adjacent walls of the second and third heat exchange units, a first strike hammer mounted on a rod and positioned closely adjacent the first strike plate, a second strike plate attached between adjacent walls of the fourth and fifth heat exchange units, a second strike hammer mounted on said rod and positioned closely adjacent the second strike plate, said rod being connected to a reciprocating motor whereby said first and second hammers vibrate against the first and second strike plates to induce vibration in the walls of the second and third heat exchange units and in the walls of the fourth and fifth heat exchange units.

12. The fuel burning assembly of claim 1 including:

a combustion burner plate assembly including a relatively horizontal combustion burner plate member located vertically spaced above the grate surface and combustion area of the grate, said burner plate member of sufficient horizontal dimension and positioned to deflect rising products of combustion back toward the combustion area of the grate; and leg means supporting the combustion burner plate member above the combustion area of the grate.

13. The fuel burning assembly of claim 12 wherein:

leg means supporting the combustion burner plate comprises a plurality of legs extending from the combustion burner plate to the grate.

14. The fuel burning assembly of claim 12 wherein:

said combustion burner plate member is formed of a ceramic type material.

15. The fuel burning assembly of claim 14 wherein:

said ceramic type material of the combustion burner plate member is alumina-silica composition composed of bulk ceramic fibers and high temperature inorganic binders.

16. The fuel burning assembly of claim 13 wherein:

said combustion burner plate member is circular with semi-circular projections for accommodation of the upper ends of the legs.

17. The fuel burning assembly of claim 16 wherein:

said combustion burner plate member is formed of a high temperature ceramic type material.

18. The fuel burning assembly of claim 17 wherein:

said ceramic type material is alumina-silica composition composed of bulk ceramic fibers and high temperature inorganic binders.

19. A solid fuel burning assembly for installation in a furnace, comprising:

a combustion air housing having walls defining a chamber and a generally flat top surface for support of a grate, and having a central fuel opening at a first central location connected to a central fuel port for passage of solid fuel from a location beneath the housing to a location above the housing;

a fuel grate located on the top surface of the housing, said fuel grate having an inner annular wall disposed in surrounding relationship to said central fuel opening of the housing with a lower edge in generally sealing relationship to the housing top surface, an outer annular wall radially spaced from the inner annular wall and having a lower edge in generally sealing relationship to the housing top surface, a grate surface extending between the inner annular wall and the outer annular wall and spaced from the top surface of the housing to support fuel during combustion in a combustion area located above the grate surface, said grate surface configured sloping gently downward from the upper edge of the inner annular wall to a trough bottom and sloping steeply upward from the trough bottom to the upper edge of the outer annular wall to form an annular solid fuel burning trough, said outer annular wall having an upper horizontal ledge, said grate surface having a plurality of air circulation openings extended between the upper edges of the inner annular wall and the outer annular wall open to the space between the grate surface and the housing top surface; a rotatable annular agitator and discharge ring mounted coaxially on the grate having an inner edge supported on the horizontal ledge of the outer annular wall of the grate and a horizontal planar upper surface for conveying ashes to the periphery of said agitator and discharge ring for discharge of the ashes;

means to rotate the agitator and discharge ring;

said housing having at least one air supply opening in the top surface thereof communicating with said chamber and located beneath the grate surface to supply air under pressure to the grate surface through the grate openings for purposes of combustion with solid fuel introduced to the grate through the fuel opening;

means to supply combustion air under pressure to said chamber including a combustion air duct connected to the combustion air housing at a second location remote from the first central location of the fuel entry port;

means to supply fuel to the grate for combustion;

a combustion burner plate assembly including a relatively horizontal combustion burner plate member located vertically spaced above the grate surface and combustion area, said burner plate member of sufficient horizontal dimension and positioned to deflect rising products of combustion back toward the combustion area of the grate assembly; and leg means supporting the combustion burner plate member above the combustion area of the grate assembly.

20. The fuel burning assembly of claim 19 wherein:

said combustion burner plate member is formed of a ceramic type material.

21. The fuel burning assembly of claim 20 wherein:

said ceramic type material of the combustion burner plate member is alumina-silica composition composed of bulk ceramic fibers and high temperature inorganic binders.

22. The fuel burning assembly of claim 19 wherein:

the means supporting combustion burner plate member comprises a plurality of legs extended from the combustion burner plate member to the grate surface.

23. The fuel burning assembly of claim 22 wherein:

said combustion burner plate member is circular with semi-circular projections for accommodation of the upper ends of the legs.

* * * * *

UNITED STATES PATENT AND TRADEMARK OFFICE

CERTIFICATE OF CORRECTION

PATENT NO. : 4,430,948

DATED : February 14, 1984

INVENTOR(S) : Tony L. Schafer et al

It is certified that error appears in the above-identified patent and that said Letters Patent is hereby corrected as shown below:

Column 5, line 32, delete "horizontally" and insert therefor -- vertically --.

Column 6, line 60, delete "37" and insert therefor -- 38 --.

Column 11, lines 22 through 62, delete because they are repetitious.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*